US006619480B2

(12) United States Patent
Smith

(10) Patent No.: US 6,619,480 B2
(45) Date of Patent: Sep. 16, 2003

(54) METHODS AND APPARATUS FOR POINT-OF-SALE PACKAGING OF CARDS

(75) Inventor: Dennis R. Smith, Minnetonka, MN (US)

(73) Assignee: UV Color, Inc., Roseville, MN (US)

( * ) Notice: Subject to any disclaimer, the term of this patent is extended or adjusted under 35 U.S.C. 154(b) by 119 days.

(21) Appl. No.: 10/039,676

(22) Filed: Oct. 26, 2001

(65) Prior Publication Data

US 2003/0080013 A1 May 1, 2003

(51) Int. Cl.[7] ..... A45C 11/18
(52) U.S. Cl. ..... 206/555; 206/454; 206/815
(58) Field of Search ..... 206/756, 769, 206/38, 449, 555, 454, 450, 815

(56) References Cited

U.S. PATENT DOCUMENTS

| | | | | |
|---|---|---|---|---|
| 3,938,091 | A | 2/1976 | Atalla et al. | |
| 4,439,636 | A | 3/1984 | Newkirk et al. | |
| 4,595,983 | A | 6/1986 | Gehalo et al. | |
| 4,706,275 | A | 11/1987 | Kamil | |
| 5,173,080 | A | 12/1992 | Longtin | |
| 5,209,514 | A | 5/1993 | Hebert | |
| 5,359,182 | A | 10/1994 | Schilling | |
| 5,504,808 | A | 4/1996 | Hamrick, Jr. | |
| 5,593,075 | A * | 1/1997 | Schumer | 224/483 |
| 5,609,253 | A | 3/1997 | Goade, Sr. | |
| 5,621,787 | A | 4/1997 | McKoy et al. | |
| 5,667,247 | A | 9/1997 | Ramsburg et al. | |
| 5,719,926 | A | 2/1998 | Hill | |
| 5,721,768 | A | 2/1998 | Stimson et al. | |
| 5,740,915 | A | 4/1998 | Williams | |
| D394,387 | S | 5/1998 | Williams | |
| 5,760,381 | A | 6/1998 | Stich et al. | |
| 5,777,305 | A | 7/1998 | Smith et al. | |
| 5,791,474 | A | 8/1998 | Hansen | |
| 5,918,909 | A | 7/1999 | Fiala et al. | |
| 5,921,584 | A | 7/1999 | Goade, Sr. | |
| 6,170,745 | B1 | 1/2001 | Schilling | |
| 6,315,206 | B1 | 11/2001 | Hansen et al. | |
| 6,439,613 | B2 * | 8/2002 | Klure | 283/62 |

* cited by examiner

*Primary Examiner*—Jacob K. Ackun
(74) *Attorney, Agent, or Firm*—Fredrikson & Byron, P.A.

(57) ABSTRACT

Methods and apparatus for the point-of-sale packaging of a card are disclosed. A package in accordance with an exemplary embodiment of the present invention comprises a pocket for receiving the card and a passageway communicating with a pocket. The package preferably also includes at least one locking tab for selectively obstructing the passageway. A method in accordance with present invention may include the steps of inserting the card into the pocket so that the card overlays the at least one locking tab, urging the package to assume a generally bent shape, and allowing the package to assume a generally planar shape in which the at least one locking tab overlays the card.

27 Claims, 15 Drawing Sheets

METHODS AND APPARATUS FOR POINT-OF-SALE PACKAGING OF CARDS

FIELD OF THE INVENTION

The present invention relates generally to cards such as, for example, gift cards and phone cards. More particularly, the present invention relates point-of-sale packaging for cards such as, for example, gift cards and phone cards.

BACKGROUND OF THE INVENTION

Debit cards have found increasing popularity in recent years. One example of a debit card is a gift card which can be used to make purchases from the establishment which issued the gift card. A second example of a debit card is a phone card which can be used to pay for long distance phone calls.

Gift cards are popular with consumers because they can greatly simplify gift buying. For example, during certain traditional times of the year many people have long lists of gifts to buy and need to complete their shopping before a certain date. In this situation, a gift card is often an attractive option. Because a wide variety of gift cards are available, a gift card can be selected to suit a particular event and/or a particular recipient. For example, at a baby shower, a gift card can be given which will allow the new parents to purchase baby-care necessities such as formula and diapers. By way of a second example, if a recipient is a lover of books, a gift card to a book store can be given.

Gift card recipients have the benefit of choosing their own gift and purchasing it using the value stored on the gift card. Using a gift card to make a purchase is very convenient. The gift card is used like a credit card, happily however, there is no bill to pay afterward. Gift cards can be given that cover a complete range of goods, from luxuries like jewelry to necessities like groceries.

Gift cards are also beneficial for businesses such as department stores. The store collects the payment when the card is purchased. As the value of the card is spent, it will be used to purchase goods and services from that store. The left over value remains on the card for later use. During a transaction using a gift card, no paperwork is required and no change need be given. The store cashier need only scan the gift card and the customer can receive a receipt which tells what value left on the card. No money needs to change hands, and no change needs to be given. To deter theft of gift cards from the store gift cards typically are not activated until they are purchased. This way the merchant can prominently display the gift cards near the cash register with little risk that the cards will be stolen since they have no value until they are activated.

SUMMARY OF THE INVENTION

The present invention relates generally to cards such as, for example, gift cards and phone cards. More particularly, the present invention relates point-of-sale packaging for cards such as, for example, gift cards and phone cards. A package in accordance with an exemplary embodiment of the present invention comprises a pocket for receiving the card and a passageway communicating with a pocket. The package preferably also includes at least one locking tab for selectively obstructing the passageway. A method of packaging a card in accordance with present invention may include the steps of laying the card onto a blank and folding the blank so that at least one locking tab overlays the card.

One implementation of the present invention includes a package for storing and displaying a card comprising a first panel having a first face and a sheet having a plurality of fixed edges and a free edge. The sheet is preferrably fixed to the first face of the first panel proximate the plurality of fixed edges so that the sheet and the first panel define a pocket. In certain implementations, the package may include a second panel at least partially overlaying the first face of the first panel. The second panel may advantageously define an aperture having a periphery. In one aspect of the invention, the free edge of the sheet and the periphery of the aperture define a passageway communicating with the pocket. In another aspect of the invention, the periphery of the aperture define at least one locking tab for selectively obstructing the passageway.

In certain implementations, the package is biased to assume a generally planar shape and the at least one locking tab extends into the passageway when the package is free to assume a generally planar shape. The locking tab may advantageously assume an unlocked position when the package is urged to assume a generally arcuate shape, wherein the passageway is substantially unobstructed by the locking tab when the locking tab assumes the unlocked position.

In one aspect of the present invention, the package comprises a distal portion, a proximal portion, and a middle portion disposed between distal portion and proximal portion. The package may be advantageously configured to preferentially bend proximate the middle portion. In this advantageous implementation, the at least one locking tab may be disposed proximate the middle portion of the package. The package may be bent proximate the middle portion so that the proximal portion of the package and the distal portion of the package are disposed at an angle relative to one another. When this is the case, the at least one locking tab may advantageously retain a generally coplanar relationship with the distal portion of the package. It should be noted that the locking tabs may be disposed in various locations without deviating from the spirit and scope of the present invention. For example, the locking tabs may be located near a side of the package. When this is the case, the package may be bent near the side to lift the locking tabs.

Another implementation of the present invention comprises an assembly including a package having a pocket and a card disposed within the pocket. The pocket may be defined by a first panel having a first face, and a sheet that is fixed to the first face of the first panel proximate a plurality of fixed edges of the sheet. The package may also include a second panel at least partially overlaying the first face of the first panel. Wherein the second panel defines an aperture having a periphery. In one aspect of the present invention, the free edge of the sheet and the periphery of the aperture define a passageway communicating with the pocket. In another aspect of the present invention, the second panel may form at least one locking tab. The at least one locking tab may selectively assume a first position in which the at least one locking tab overlays the card and a second position in with the card overlays the at least one locking tab.

A method of packaging and displaying a card in accordance with the present invention may include the step of providing a package having a passageway communicating with a pocket, and at least one locking tab for selectively obstructing the passageway. A card may be inserted into the pocket so that the card overlays the at least one locking tab. The package may be urged to assume a generally bent shape, and the package may be allowed to assume a generally planar shape in which the at least one locking tab overlays the card.

DETAILED DESCRIPTION OF THE PREFERRED EMBODIMENT

The following detailed description should be read with reference to the drawings, in which like elements in different drawings are numbered identically. The drawings, which are not necessarily to scale, depict selected embodiments and are not intended to limit the scope of the invention. Examples of constructions, materials, dimensions, and manufacturing processes are provided for selected elements. All other elements employ that which is known to those of skill in the field of the invention. Those skilled in the art will recognize that many of the examples provided have suitable alternatives that can be utilized.

Figure 1:
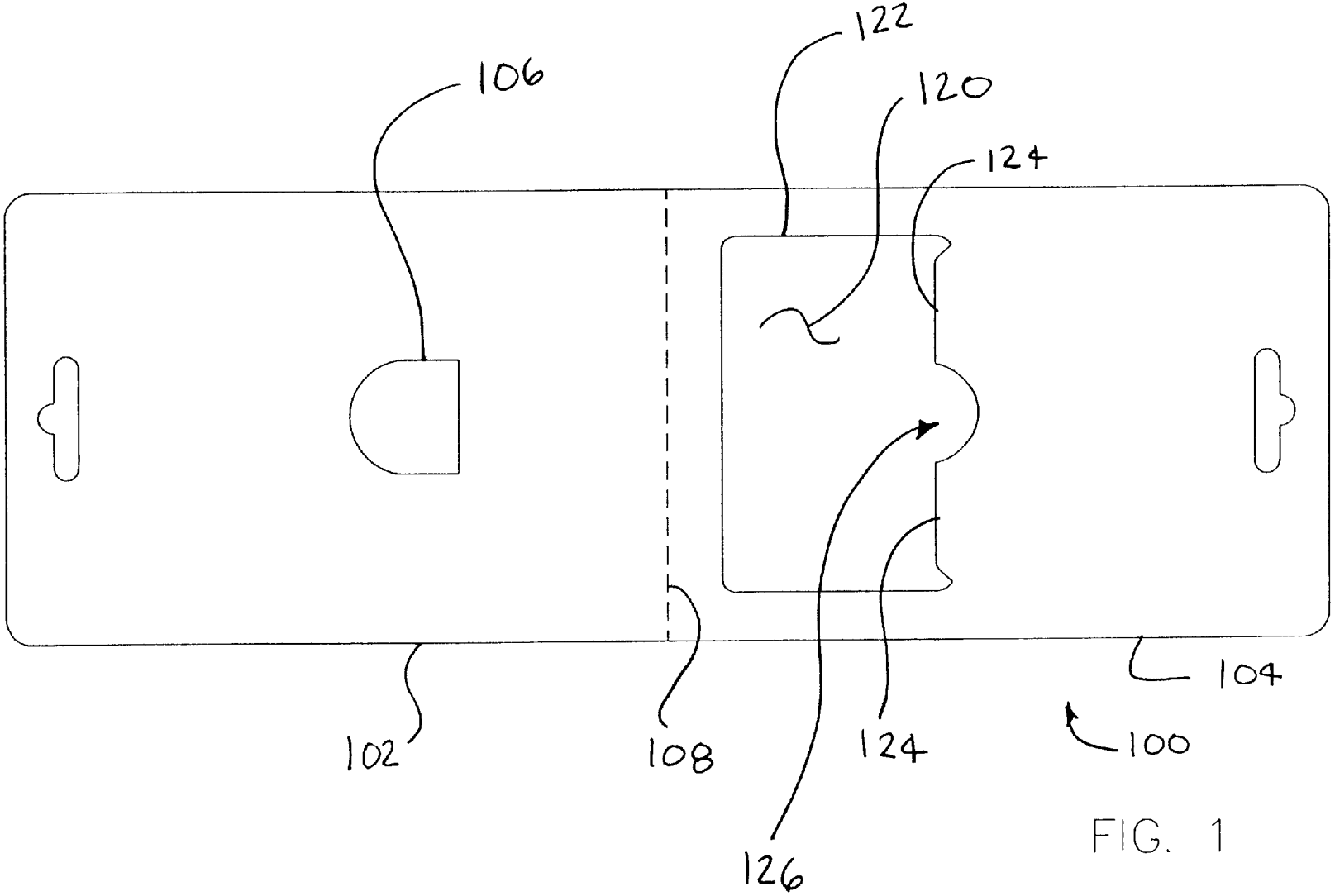
FIG. 1 is a plan view of a blank which may be used to form a package in accordance with the present invention.

FIG. 1 is a plan view of a blank 100 which may be used to form a package in accordance with the present invention. Blank 100 includes a first panel 102 and a second panel 104. First panel 102 of blank 100 defines a opening 106. First panel 102 and second panel 104 are joined at a fold line 108 represented by a dashed line in FIG. 1. In a preferred embodiment, fold line 108 comprises a localized area of weakness. This localized area of weakness may comprise various elements without deviating from the spirit and scope of the present invention. Examples of elements which may be suitable in some applications include a perf cut, a cut score, and a crease score. It should also be appreciated that embodiments of blank 100 are possible in which first panel 102 and second panel 104 are not joined by fold line 108.

In FIG. 1 it may be appreciated that second panel 104 defines an aperture 120 having a periphery 122. In the embodiment of FIG. 1, periphery 122 defines a plurality of locking tabs 124 extending into aperture 120. Also in the embodiment of FIG. 1, periphery 122 defines a notch 126 disposed between two locking tabs 124. In a preferred embodiment, notch 126 defined by second panel 104 and opening 106 defined by first panel 102 are positioned so that they will be generally aligned with one another when blank 100 is folded along fold line 108.

In the embodiment of FIG. 1, opening 106 has an extent that is similar to the extents of a human finger. In a preferred embodiment, the extent of opening 106 is somewhat larger than the extents of a human finger. Also in a preferred embodiment, the extent of opening 106 is similar to the extent of notch 126. In the embodiment of FIG. 1, the extent of opening 106 is slightly larger than the extent of notch 126.

Figure 2:
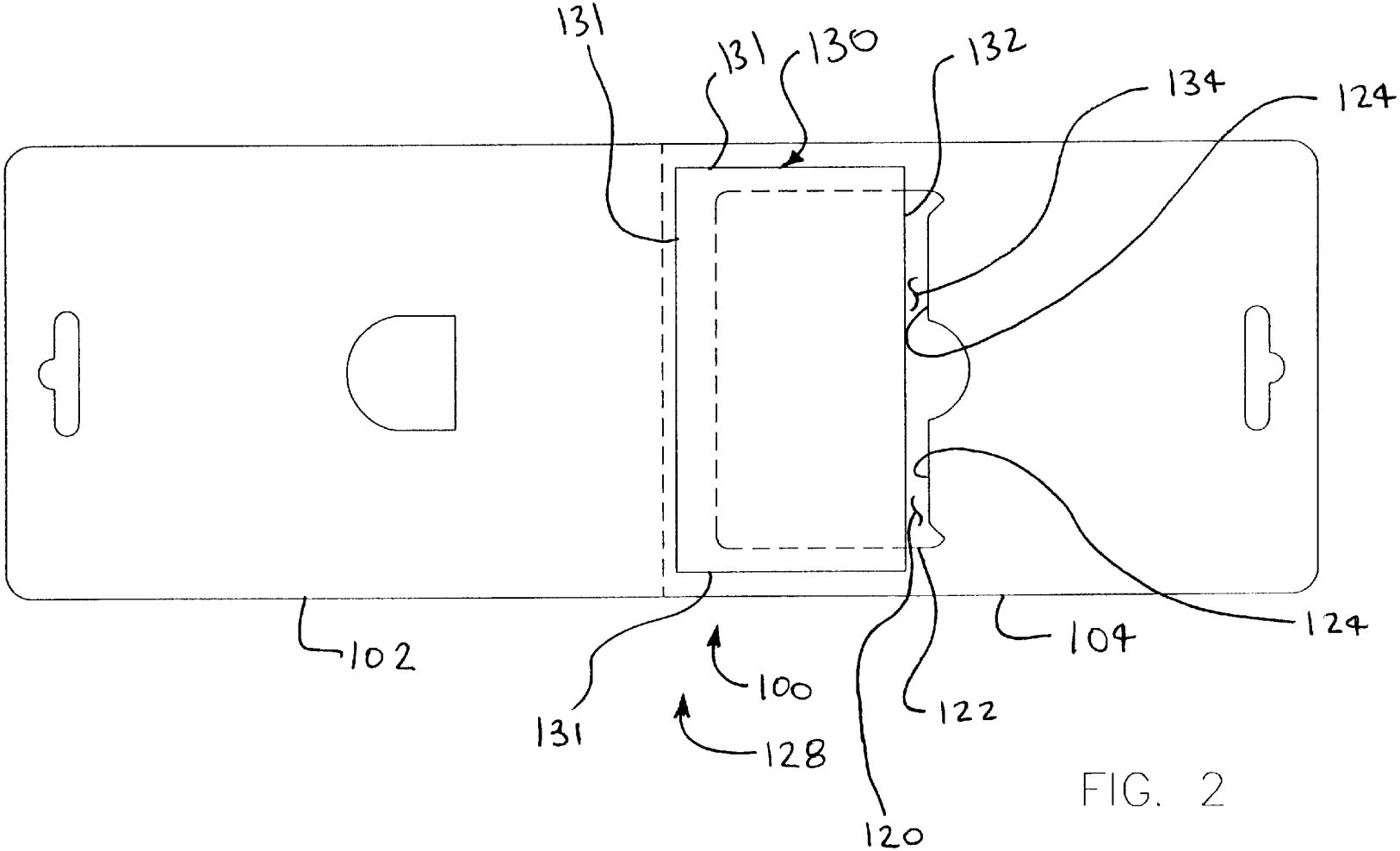
FIG. 2 is a plan view of an assembly in accordance with an exemplary embodiment of the present invention.

FIG. 2 is a plan view of an blank assembly 128 in accordance with an exemplary embodiment of the present invention. Blank assembly 128 includes blank 100 of FIG. 1, and a sheet 130. Sheet 130 includes a plurality of fixed edges 131 and a free edge 132.

In a preferred embodiment, sheet 130 comprises an optically transparent and/or translucent material. Also in a preferred embodiment, sheet 130 comprises a low friction material. It is to be appreciated that sheet 130 may comprise various materials without deviating from the spirit and scope of the present invention. Examples of materials which may be suitable in some applications include: polyethylene (PE), polypropylene (PP), polyvinylchloride (PVC), polyvinylchloride/polyvinyl acetate copolymers, polyethylene terephthalate (PET), and polyethylene terephthalate glycol (PETG).

As discussed previously, second panel 104 defines an aperture 120 having a periphery 122. In the embodiment of FIG. 2, free edge 132 of sheet 130 and periphery 122 of aperture 120 define a passageway 134. In a preferred embodiment, passageway 134 is dimensioned so that a card in accordance with the present invention may pass therethrough. A card in accordance with the present invention is preferably sized to fit in a typical wallet. In FIG. 2 it may be appreciated that second panel 104 forms a plurality of locking tabs 124. In the embodiment of FIG. 2, locking tabs 124 are positioned so as to at least partially obstruct passageway 134.

Figure 3:
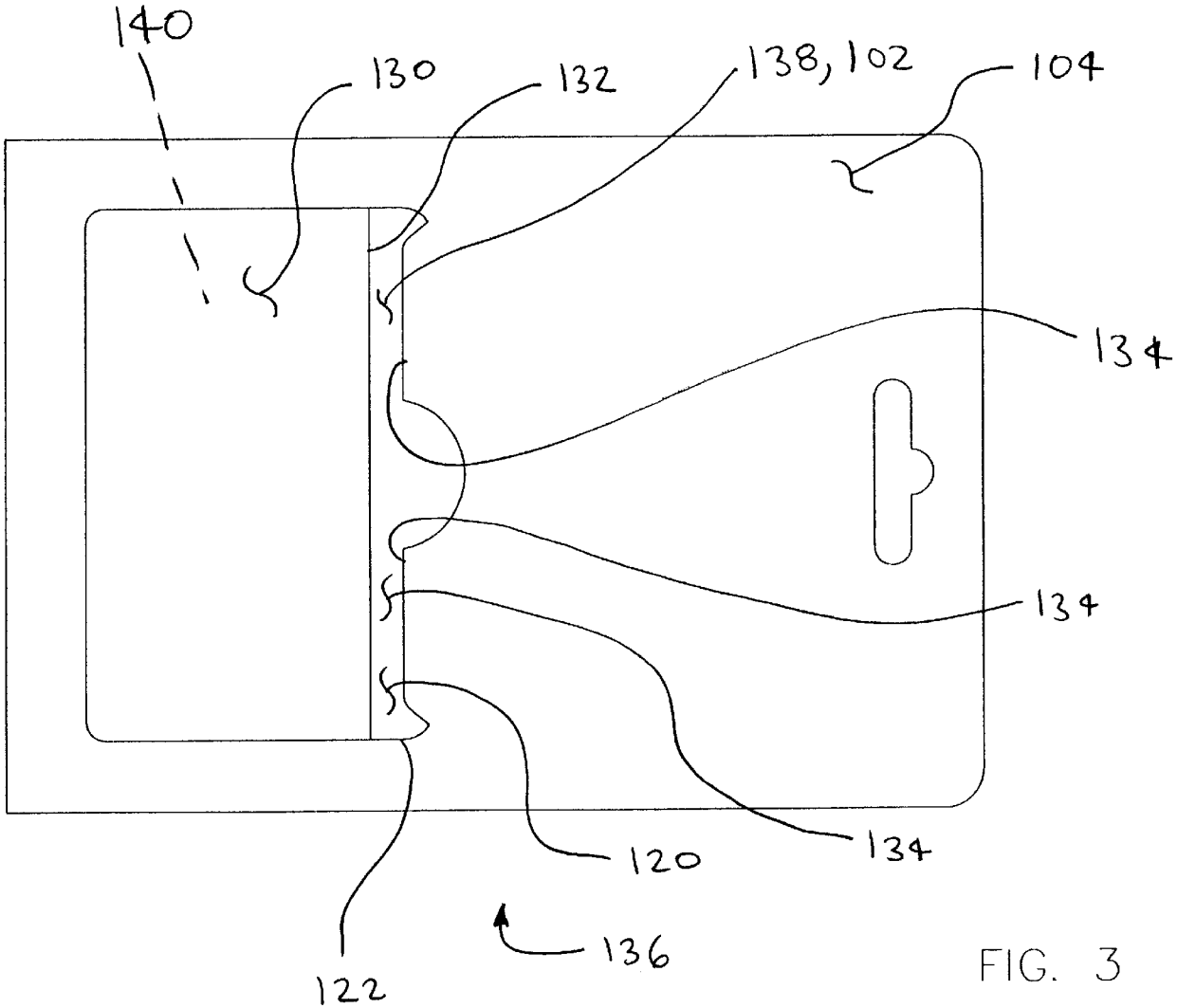
FIG. 3 is a plan view of an additional assembly in accordance with an exemplary embodiment of the present invention.

FIG. 3 is a plan view of a package 136 in accordance with an exemplary embodiment of the present invention. Package 136 may be formed by folding the assembly of FIG. 2 along fold line 108. Package 136 includes a sheet 130 having a plurality of fixed edges and a free edge 132. In the embodiment of FIG. 3, sheet 130 is fixed to a first face 138 of first panel 102 proximate the fixed edges so that sheet 130 and first panel 102 define a pocket 140. Sheet 130 may be fixed to first face 138 of first panel 102, for example, by an adhesive layer disposed between first face 138 of first panel 102 and sheet 130. In a preferred embodiment, pocket 140 is dimensioned to accept a card in accordance with the present invention.

In a preferred embodiment, sheet 130 is fixed to both first panel 102 and second panel 104, for example, with an adhesive. Also in a preferred embodiment, first panel 102 is fixed to second panel 104, for example, with an adhesive.

Free edge 132 of sheet 130 and periphery 122 of aperture 120 define a passageway 134 communicating with pocket 140. Second panel 104 forms a plurality of locking tabs 124. In the embodiment of FIG. 3, locking tabs 124 are positioned so as to at least partially obstruct passageway 134. In a preferred embodiment, passageway 134 is dimensioned so that a card may pass through passageway 134 into or out of pocket 140.

Figure 4:
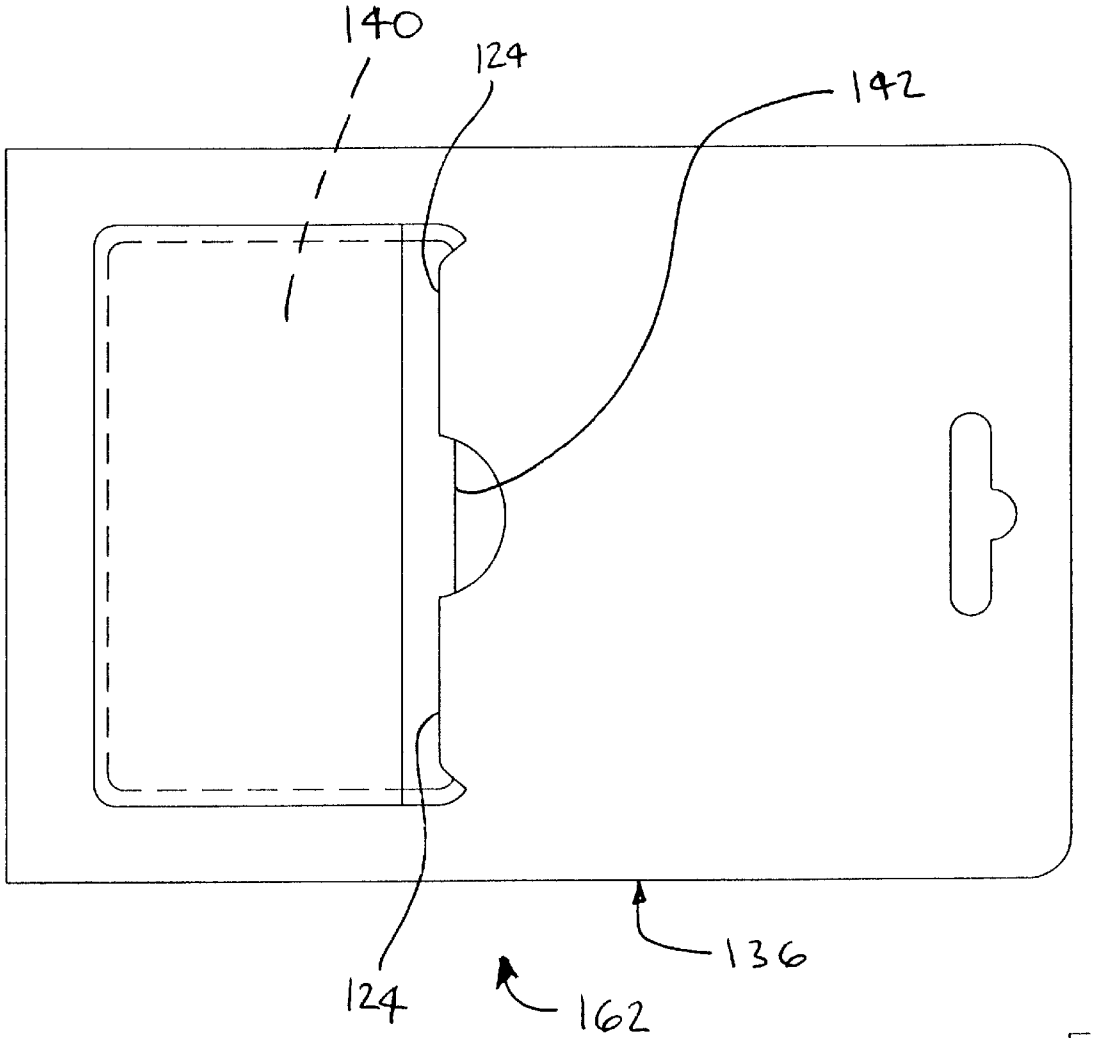
FIG. 4 is a plan view of an assembly in accordance with an additional exemplary embodiment of the present invention.

FIG. 4 is a plan view of an assembly 162 in accordance with an exemplary embodiment of the present invention. Assembly 162 includes a package 136 and a card 142 that is disposed within a pocket 140 of package 136. In FIG. 4 locking tabs 124 of package 136 are shown overlaying card 142. In a preferred embodiment, locking tabs 124 may be positioned to selectively hold card 142 within pocket 140. Assembly 162 may be formed by laying card 142 on a blank (e.g. blank assembly 128 of FIG. 2) and folding the blank so that at least one locking tab overlays the card.

Figure 5:
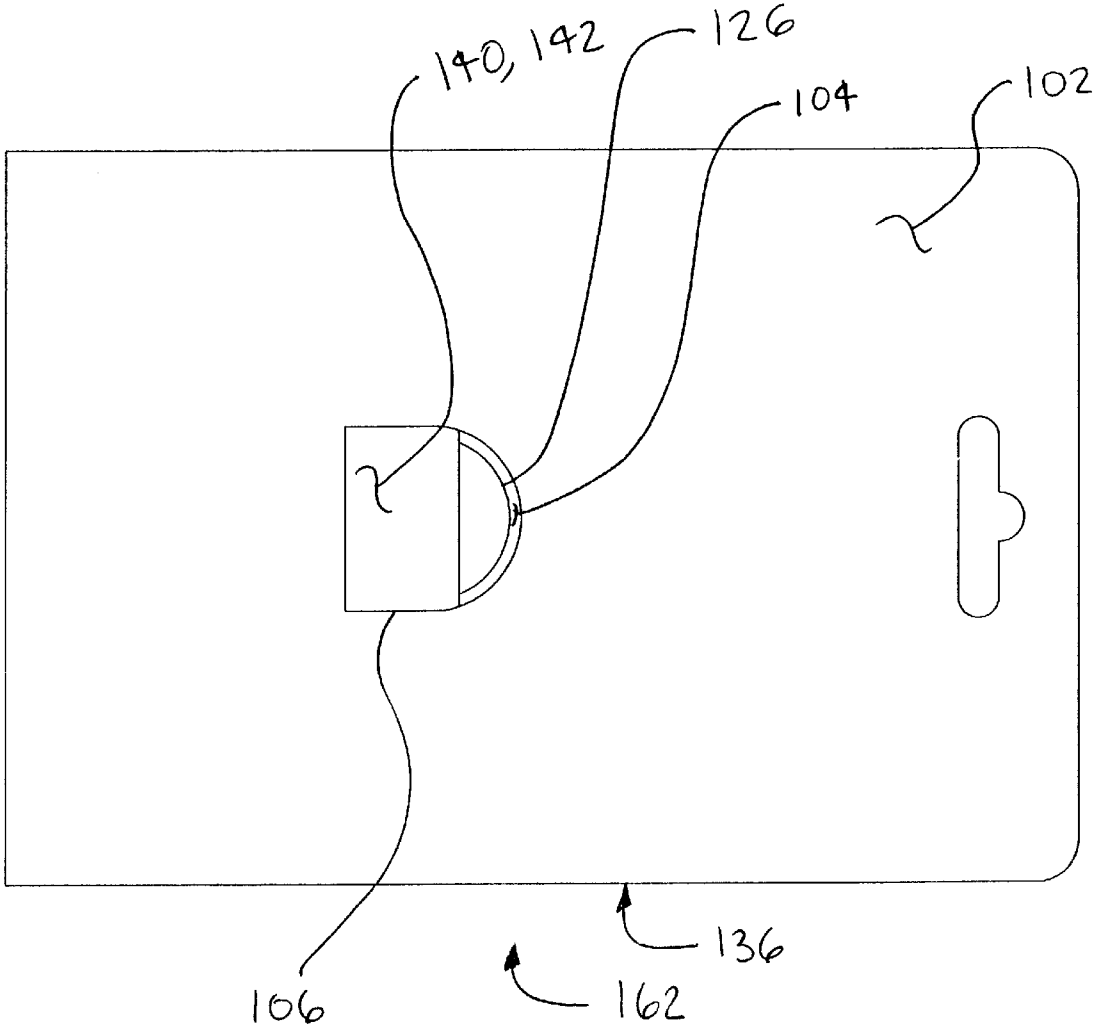
FIG. 5 is a plan view of a back side of the assembly of FIG. 4.

FIG. 5 is a plan view of a back side of assembly 162 of FIG. 4. In FIG. 5 it may be appreciated that first panel 102 of package 136 defines an opening 106. In the embodiment of FIG. 5, opening 106 is generally concentric with notch 126 defined by second panel 104 of package 136. In FIG. 5 it may be appreciated that opening 106 is positioned so as to communicate with pocket 140. Thus, card 142 disposed in pocket 140 is visible through opening 106 in FIG. 5.

In FIG. 5 it may also be appreciated that opening 106 and notch 126 are sized and positioned to allow access to a portion of card 142. In a preferred embodiment, opening 106 is dimensioned to receive a human finger. In one method in accordance with the present invention, a human finger may be used to urge card 142 through passageway 134.

Figure 6:
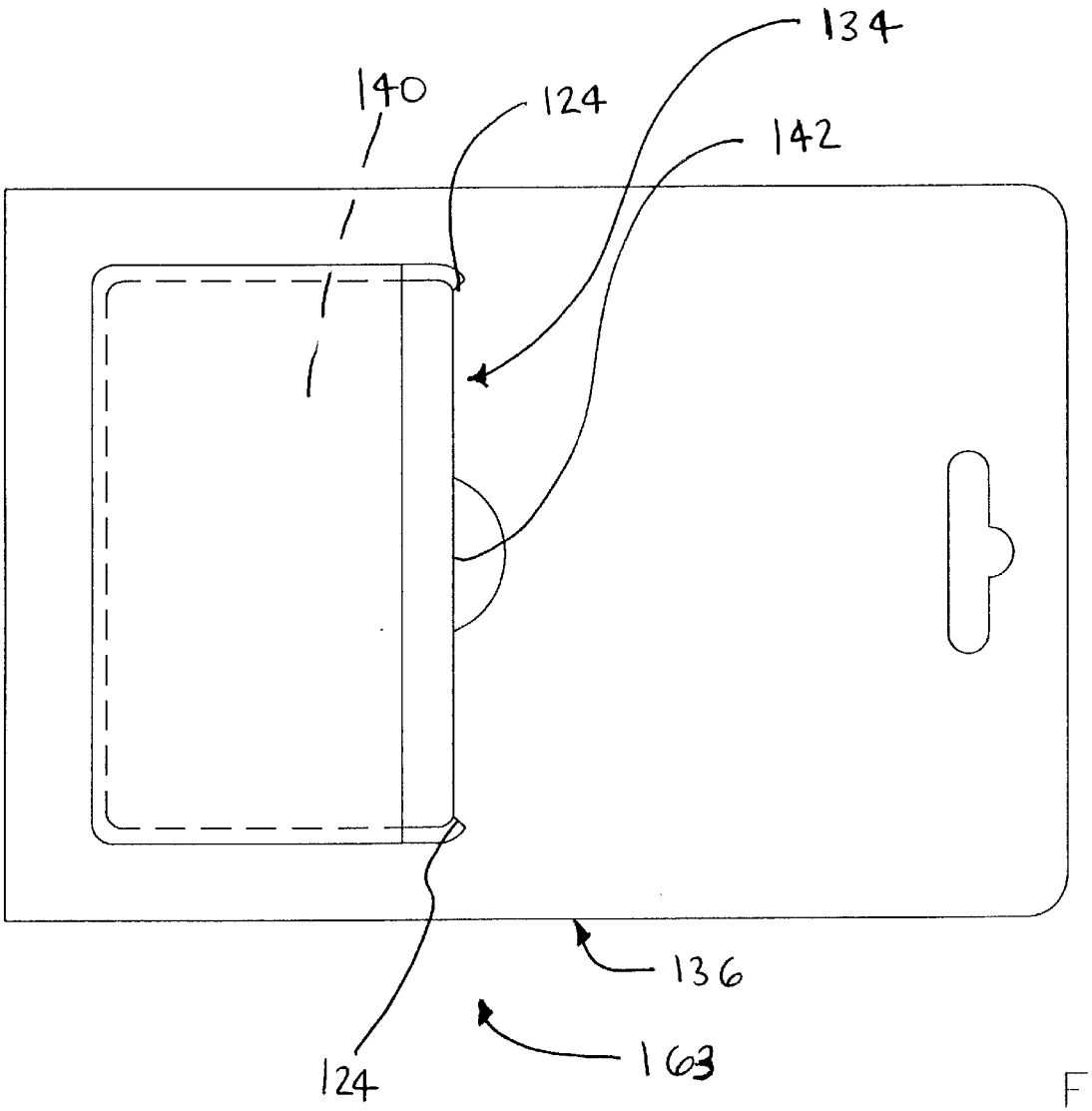
FIG. 6 is a plan view of an assembly in accordance with an additional exemplary embodiment of the present invention.

FIG. 6 is a plan view of an assembly 163 in accordance with an additional exemplary embodiment of the present invention. As in the previous embodiment, assembly 163 includes a package 136 and a card 142 disposed within pocket 140 of package 136. In the embodiment of FIG. 6 card 142 is seen overlaying locking tabs 124 of package 136. When card 142 is overlaying locking tabs 124, card 142 is preferably free to exit pocket 140 via passageway 134 of package 136.

Figure 7:
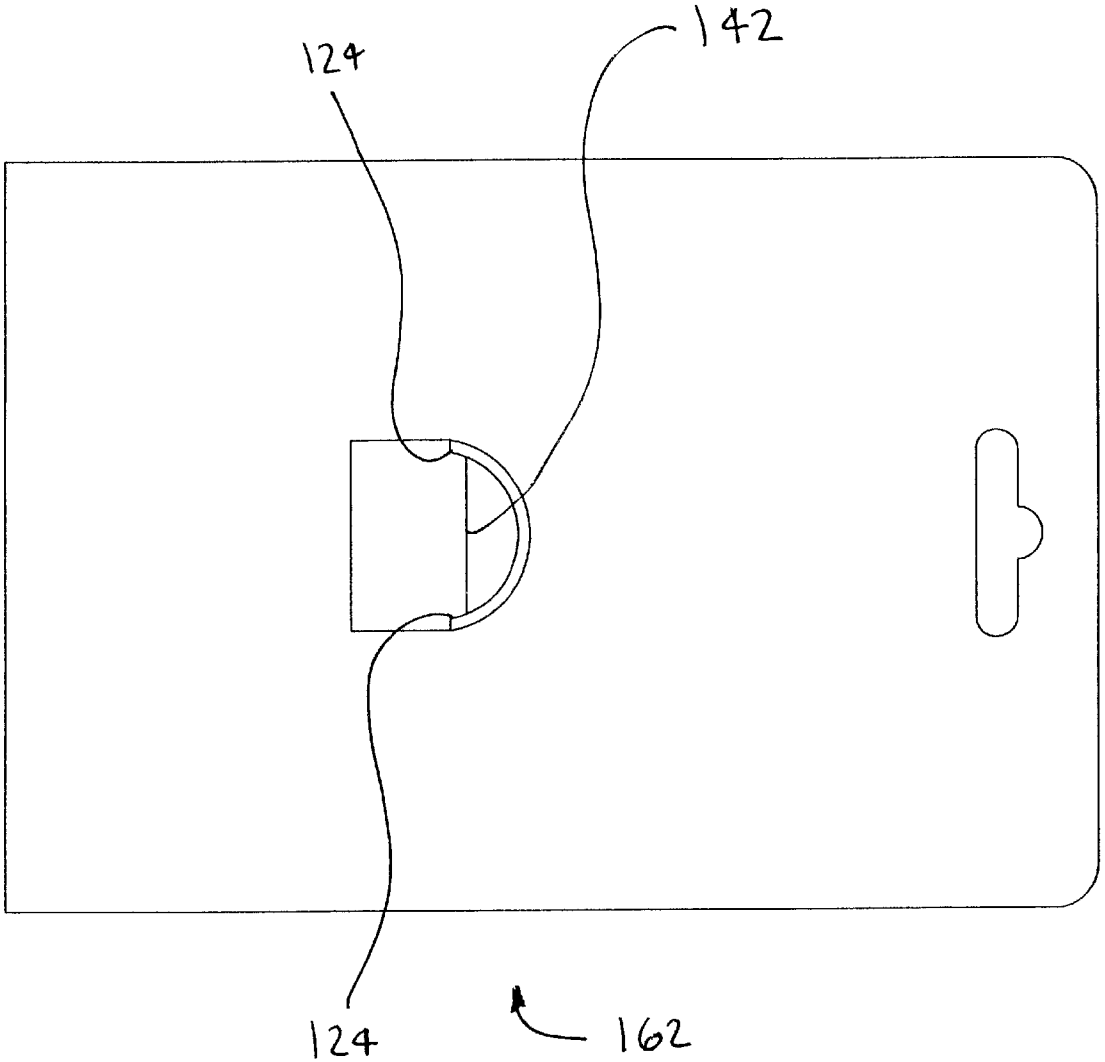
FIG. 7 is a plan view of a back side of assembly of FIG. 6.

FIG. 7 is a plan view of a back side of assembly 163 of FIG. 6. In FIG. 7 it can appreciated that locking tabs 124 are disposed underneath card 142. A method in accordance with present invention may include the steps of grasping assembly 162 of FIG. 4, urging package 136 to assume a generally bent shape, and allowing package 136 to assume a generally planar shape in which card 142 overlays locking tabs 142.

Figure 8:
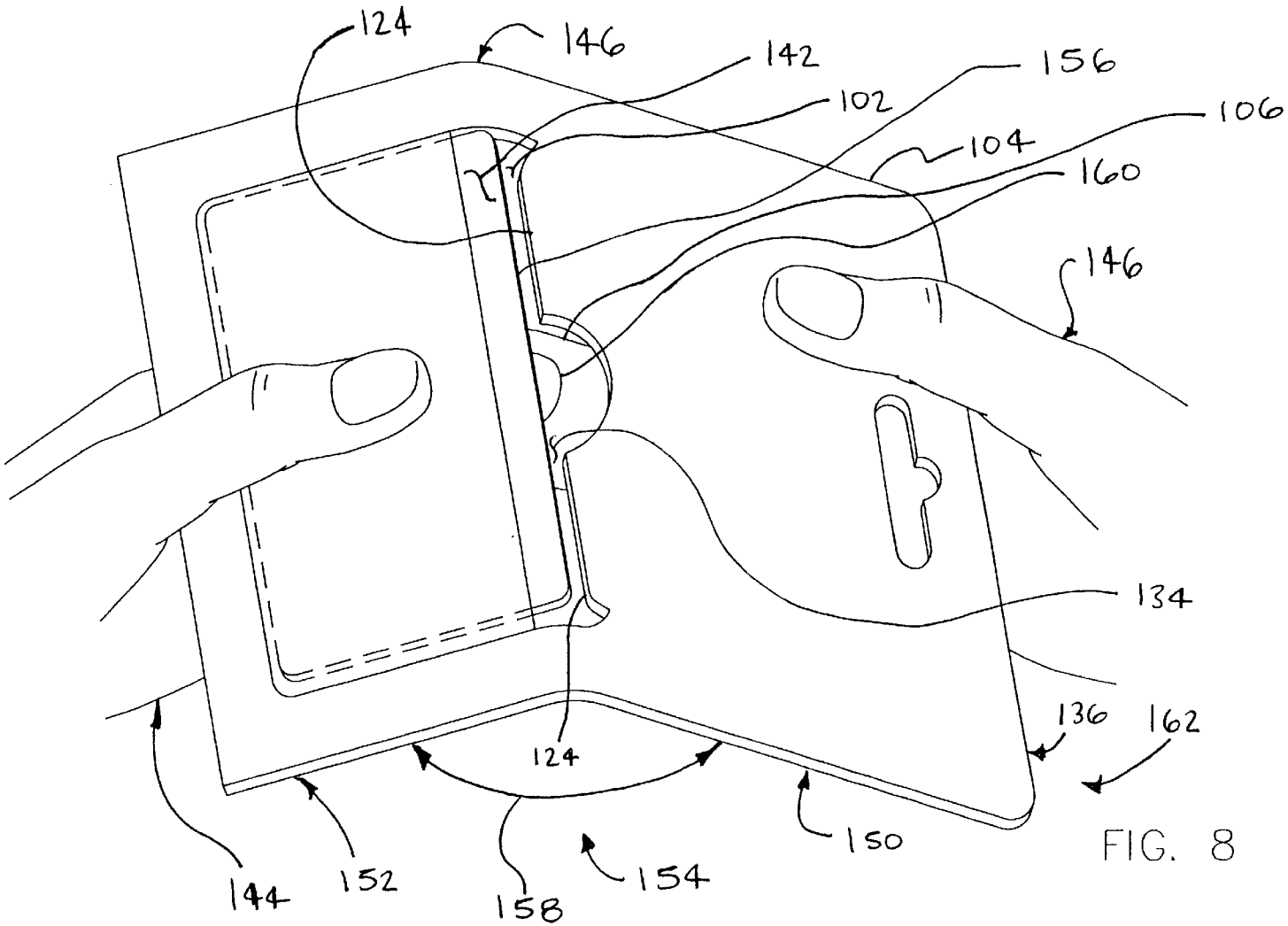
FIG. 8 is a perspective view of an assembly in accordance with the present invention.

FIG. 8 is a perspective view of an assembly 162 in accordance with the present invention. In the embodiment of FIG. 8, assembly 162 is being grasped by a left hand 144 and a right hand 146. In the embodiment of FIG. 8, package 136 has been urged to assume a generally arcuate or bent shape by left hand 144 and right hand 146. Thus, assembly 162 of FIG. 8 includes a bend 148.

In the embodiment of FIG. 8, assembly 162 comprises a distal portion 150, a proximal portion 152, and a middle portion 154 disposed between distal portion 150 and proximal portion 152. In a preferred embodiment, assembly 162 is configured to preferentially bend proximate middle portion 154. In some preferred embodiments, card 142 may be generally more rigid than first panel 102 and/or second panel 104 of package 136. In FIG. 8 it may be appreciated that bend 148 in assembly 162 is disposed proximate an upper edge 156 of card 142.

Card 142, first panel 102, and second panel 104 may comprise various materials without deviating from the spirit and scope of the present invention. In one advantageous embodiment, card 142 comprises a polyvinylchloride (PVC) sheet having a thickness of about 0.032 inches, and the panels (first panel 102 and second panel 104) comprise cellulostic card stock having a thickness of about 0.014 inches.

In the embodiment of FIG. 8 locking tabs 124 are disposed in a generally coplanar position relative to distal portion 150 of package 136. In FIG. 8, it may also be appreciated that proximal portion 152 of package 136 and distal portion 150 of package 136 are disposed at an angle 158 relative to one another.

In a preferred embodiment, assembly 162 is biased to assume a generally planer shape, and has a level of flexibility which allows it to be urged into the shape shown in FIG. 8. In FIG. 8 it may be appreciated that locking tabs 124 are not overlaying card 142. Thus, when assembly 162 is urged into the shape shown in FIG. 8, locking tabs 124 preferably do not obstruct the travel of card 142 through passageway 134. When this is the case, card 142 may preferably pass through passageway 134.

Card 142 may be urged through passageway 134, for example, by a human finger 160. In FIG. 8, it maybe appreciated that human finger 160 has been received in an opening 106 defined by first panel 102. In one method in accordance with the present invention, card 142 is urged through passageway 134 by applying a pushing force with human finger 160 disposed in opening 106 defined by first panel 102. In another method in accordance with the present invention, card 142 may be positioned to overlay locking tabs 124 by applying a pushing force on card 142 with human finger 160 disposed in opening 106 while urging package 136 into a generally arcuate shape, then allowing package 136 to assume a generally planar shape.

In a preferred embodiment, proximal portion 152 and distal portion 150 of package 136 are both dimensioned to be received by a human hand. In the embodiment of FIG. 8, proximal portion 152 is received by a left hand 144 and distal portion 150 is received by a right hand 146.

Figure 9:
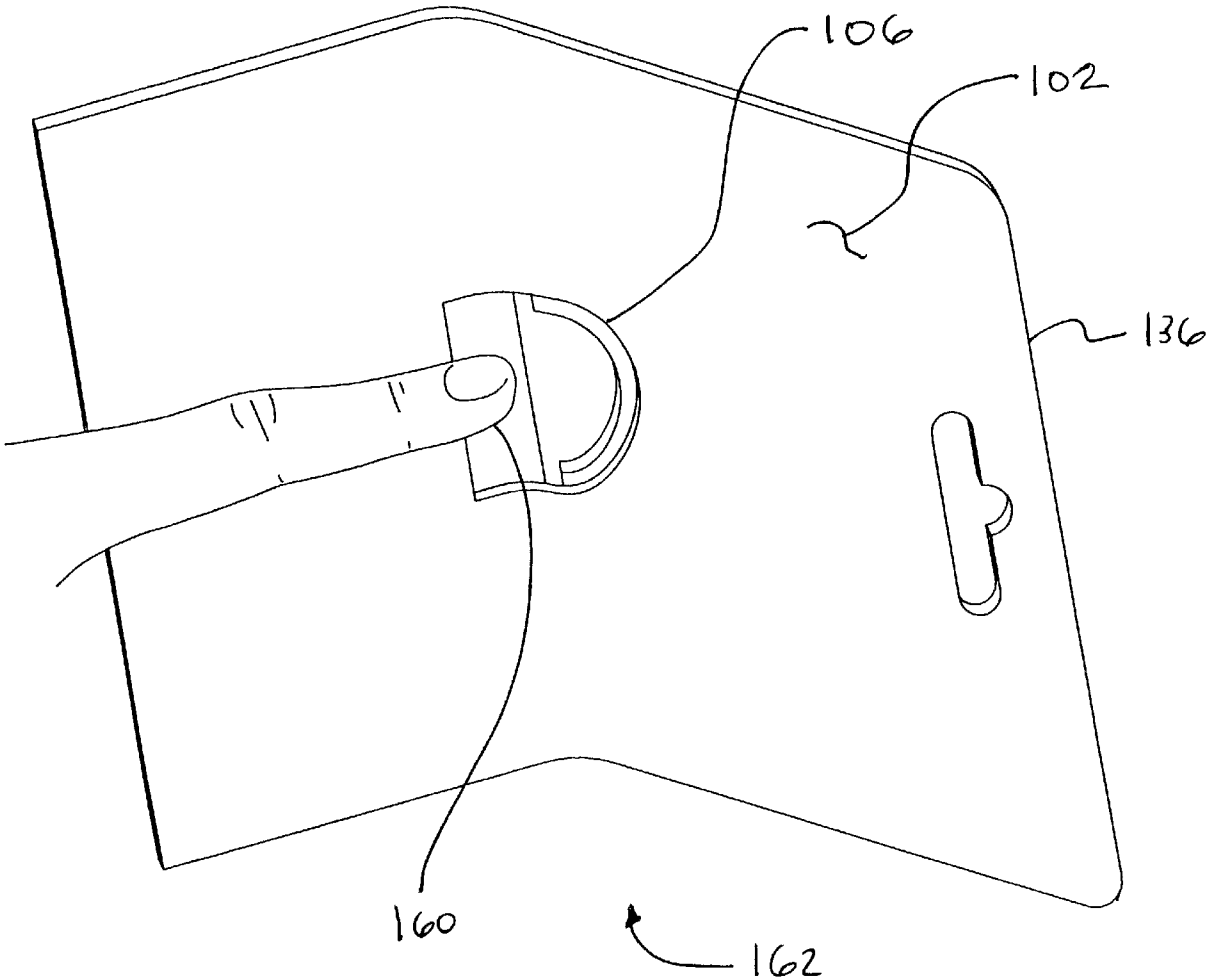
FIG. 9 is an additional perspective view of assembly of FIG. 8.

FIG. 9 is an additional perspective view of assembly 162 of FIG. 8. A back side of assembly 162 is shown on FIG. 9. In the embodiment of FIG. 9, package 136 is disposed in a generally bent or arcuate shape. Human finger 160 is shown disposed within opening 106 defined by first panel 102. In FIG. 9, it may be appreciated that opening 106 is suitably sized to receive human finger 160. In a preferred embodiment, the extent of opening 106 is somewhat larger than that of human finger 160.

Figure 10:
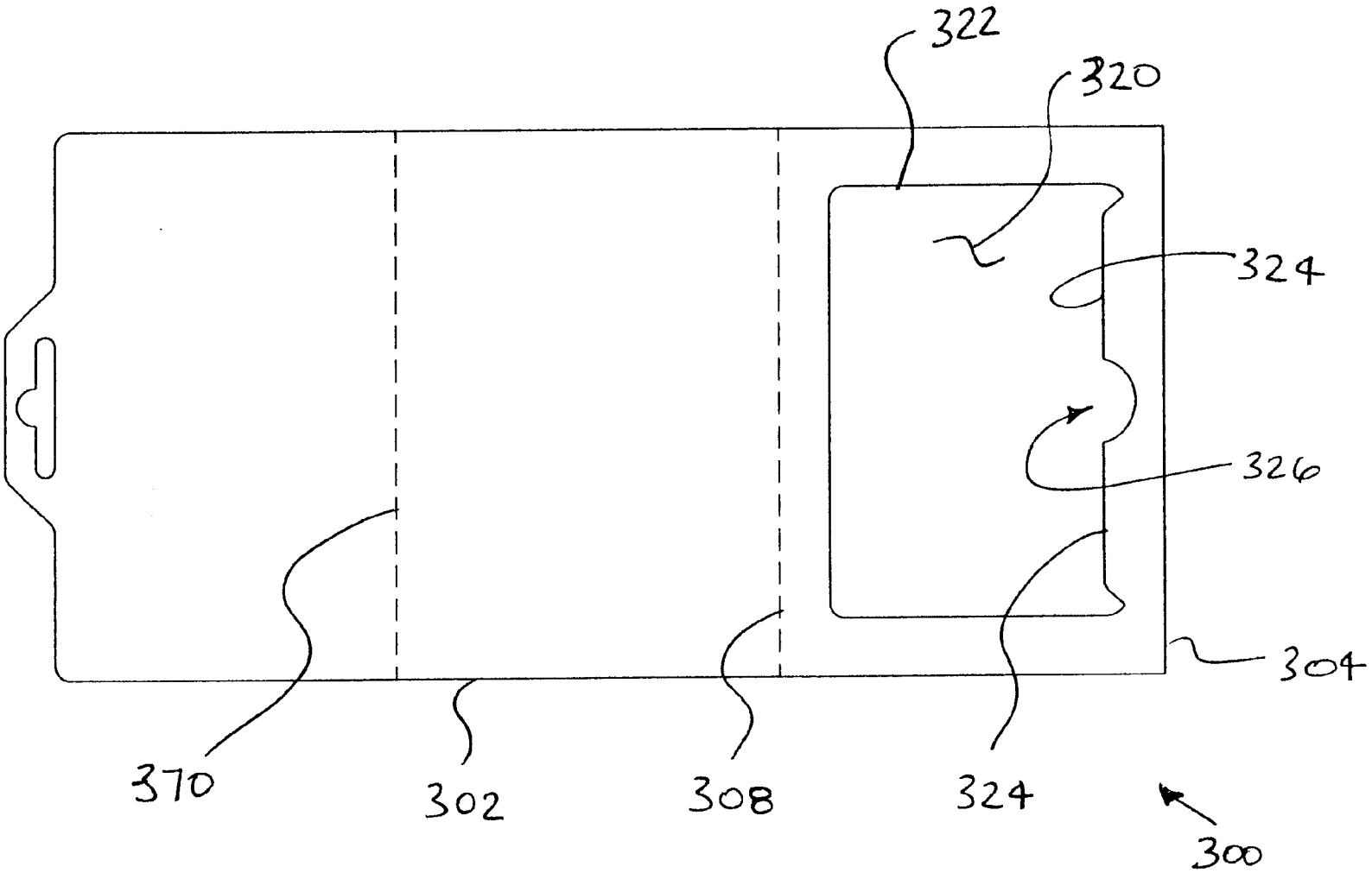
FIG. 10 is a plan view of a blank which may be used to form a package in accordance with the present invention.

FIG. 10 is a plan view of a blank 300 which may be used to form a package in accordance with the present invention. Blank 300 includes a first panel 302 and a second panel 304. First panel 302 and second panel 304 are joined at a fold line 308 represented by a dashed line in FIG. 10. In the embodiment of FIG. 10, first panel 302 includes a second fold line 370. In a preferred embodiment, fold line 308 and second fold line 370 each comprise a localized area of weakness. A localized area of weakness may comprise various elements without deviating from the spirit and scope of the present invention. Examples of elements which may be suitable in some applications include a perf cut, a cut score, and a crease score.

In FIG. 10 it may be appreciated that second panel 304 defines an aperture 320 having a periphery 322. In the embodiment of FIG. 10, periphery 322 defines a plurality of locking tabs 324 extending into aperture 320. Also in the embodiment of FIG. 10, periphery 322 defines a notch 326 disposed between two locking tabs 324.

Figure 11:
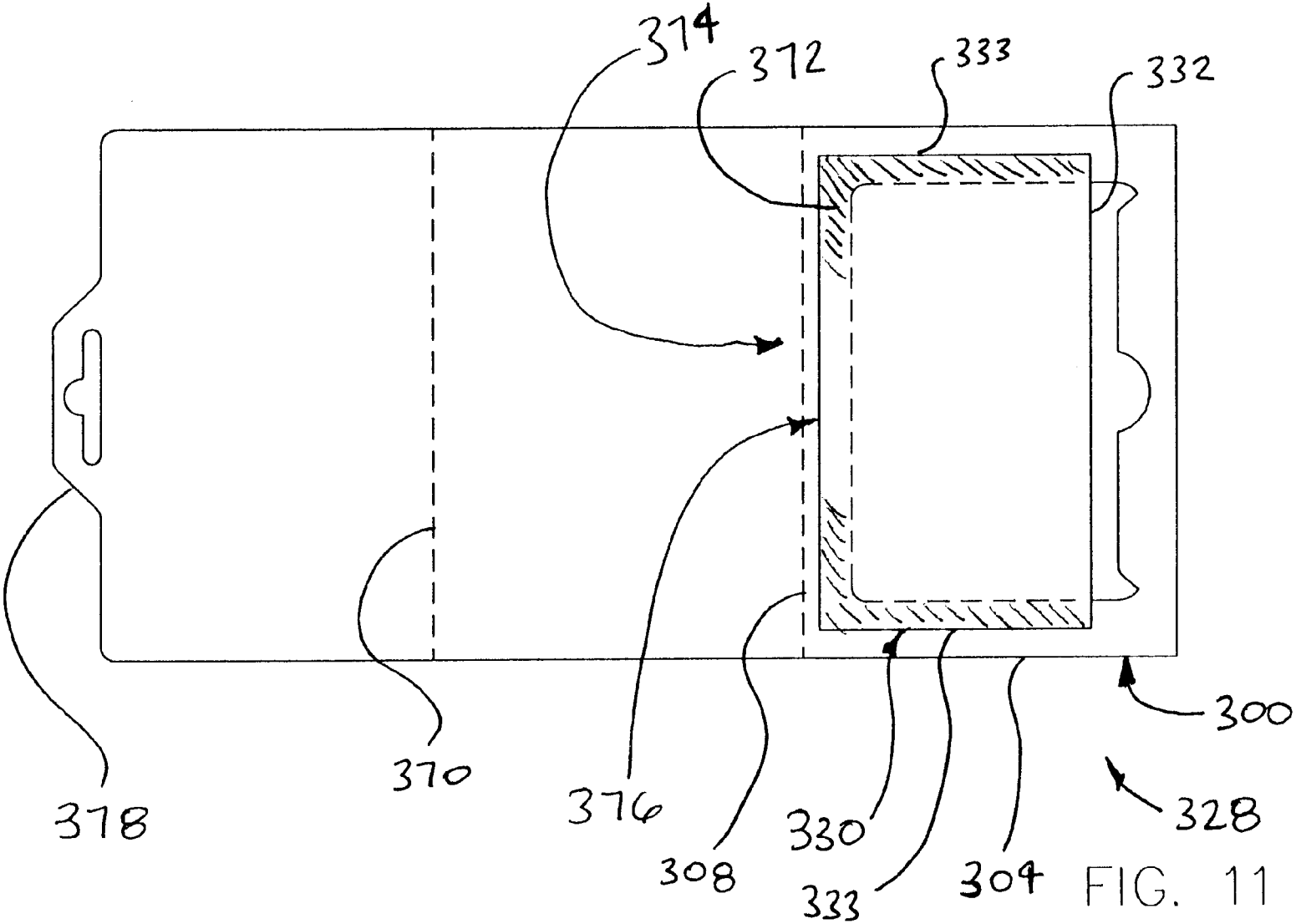
FIG. 11 is a plan view of an blank assembly in accordance with an exemplary embodiment of the present invention.

FIG. 11 is a plan view of an blank assembly 328 in accordance with an exemplary embodiment of the present invention. Blank assembly 328 includes blank 300 of FIG. 10, and a sheet 330. Sheet 330 includes a plurality of fixed edges 333 and a free edge 332. In the embodiment of FIG. 11, sheet 330 is fixed to second panel 304 of blank 300 by an adhesive 372. In FIG. 11, it may be appreciated that adhesive 372 defines a gap 374. In the embodiment of FIG. 11, gap 374 is positioned so that second panel 304 and sheet 330 define a receptacle 376 near fold line 308.

In the embodiment of FIG. 11, first panel 302 of blank 300 includes a flap 378. In a preferred embodiment, receptacle 376 and flap 378 are dimensioned so that flap 378 may be selectively received in receptacle 376 when blank 300 is folded along fold line 308 and second fold line 370.

Figure 12:
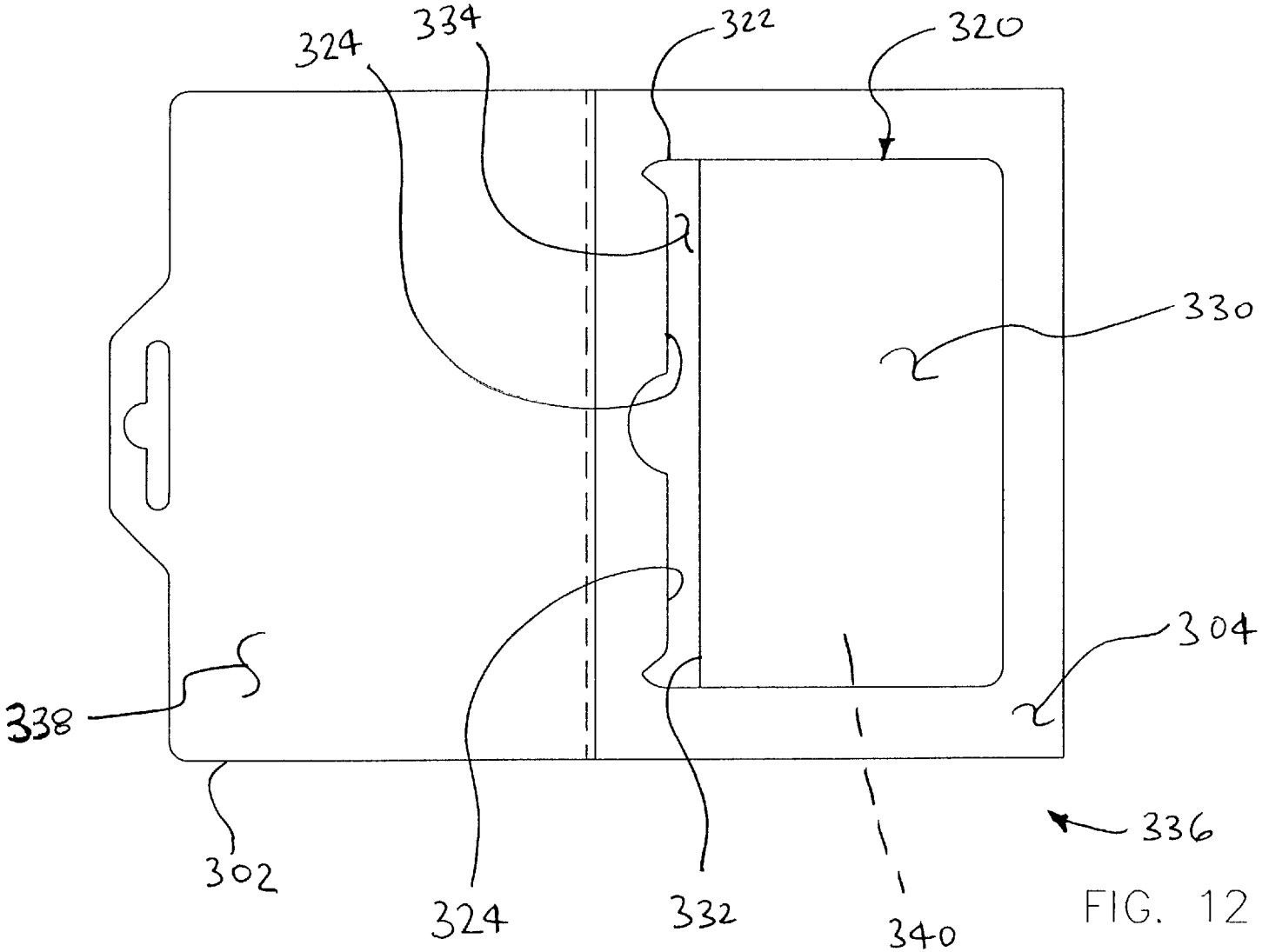
FIG. 12 is a plan view of a package in accordance with an exemplary embodiment of the present invention.

FIG. 12 is a plan view of a package 336 in accordance with an exemplary embodiment of the present invention. Package 336 may be formed by folding the assembly of FIG. 11 along fold line 308. Package 336 includes a sheet 330 having a plurality of fixed edges and a free edge 332. In the embodiment of FIG. 12, sheet 330 is fixed to a first face 338 of first panel 302 proximate the fixed edges so that sheet 330 and first panel 302 define a pocket 340. Sheet 330 may be fixed to first face 338 of first panel 302, for example, by an adhesive layer disposed between first face 338 of first panel 302 and sheet 330. In a preferred embodiment, pocket 340 is dimensioned to accept a card in accordance with the present invention.

Free edge 332 of sheet 330 and periphery 322 of aperture 320 define a passageway 334 communicating with pocket 340. Second panel 304 forms a plurality of locking tabs 324. In the embodiment of FIG. 12, locking tabs 324 are positioned so as to at least partially obstruct passageway 334. In a preferred embodiment, passageway 334 is dimensioned so that a card may pass through passageway 334 into or out of pocket 340.

Figure 13:
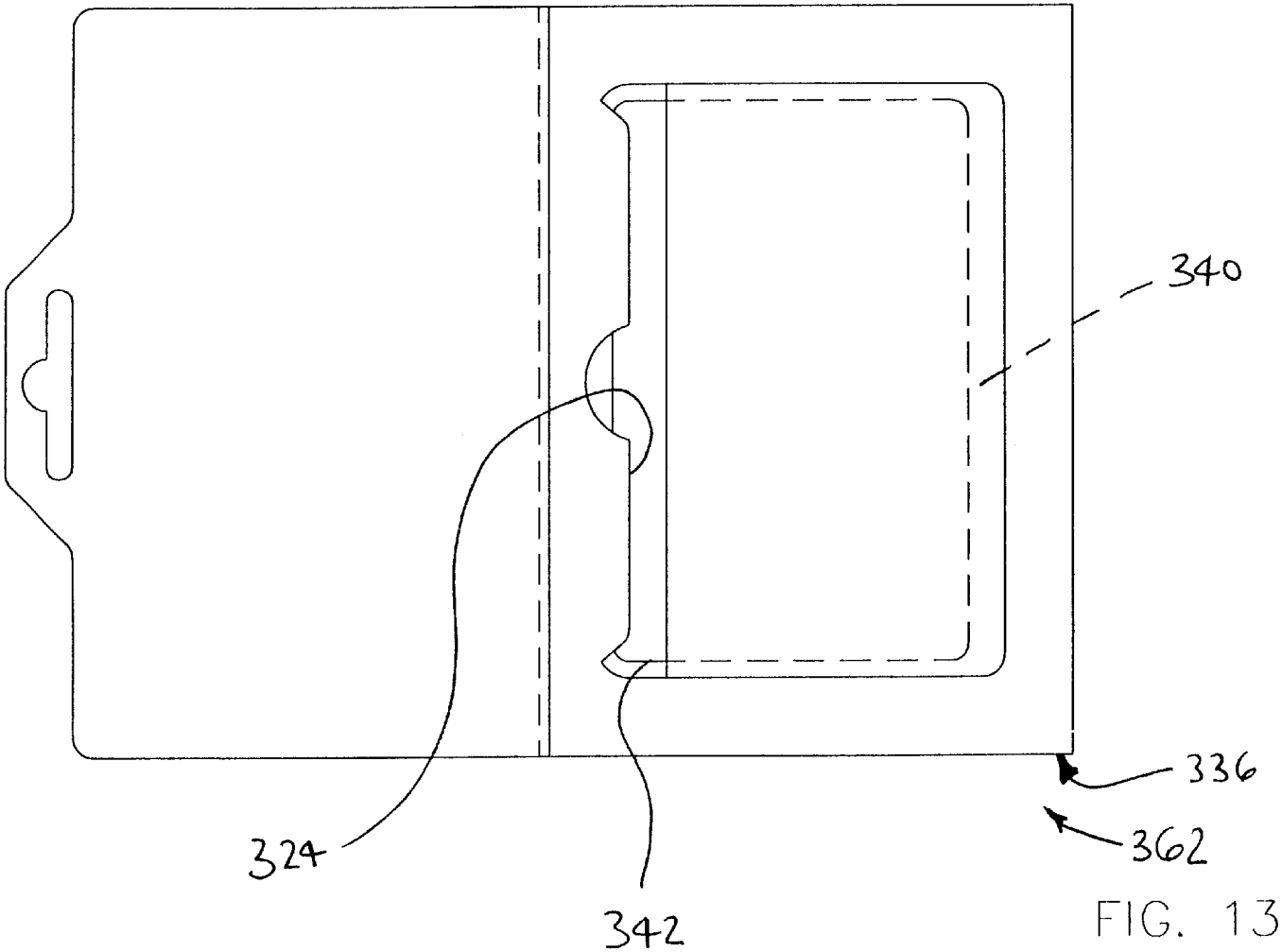
FIG. 13 is a plan view of an assembly in accordance with an exemplary embodiment of the present invention.

FIG. 13 is a plan view of an assembly 362 in accordance with an exemplary embodiment of the present invention. Assembly 362 includes a package 336 and a card 342 that is disposed within a pocket 340 of package 336. In FIG. 13 locking tabs 324 of package 336 are shown overlaying card 342. In a preferred embodiment, locking tabs 324 may be positioned to selectively hold card 342 within pocket 340. Assembly 362 may be formed by laying card 342 on a blank (e.g. blank assembly 328 of FIG. 11) and folding the blank so that at least one locking tab overlays card 342.

Figure 14:
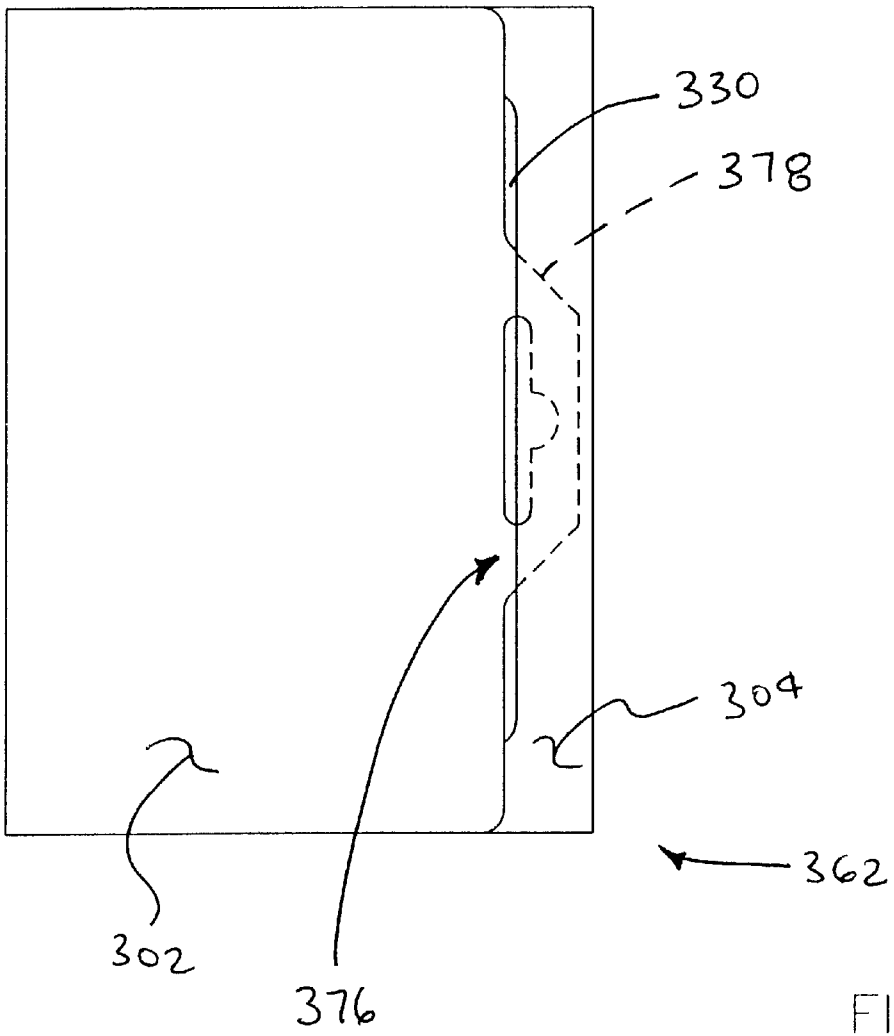
FIG. 14 is an additional plan view of the assembly of FIG. 13.

FIG. 14 is an additional plan view of assembly 362 of FIG. 13. In the embodiment of FIG. 14, first panel 302 has been folded so that a portion of first panel 302 overlays card 342. Also in the embodiment of FIG. 14, flap 378 is disposed within receptacle 376 defined by second panel 304 and sheet 330.

Figure 15:
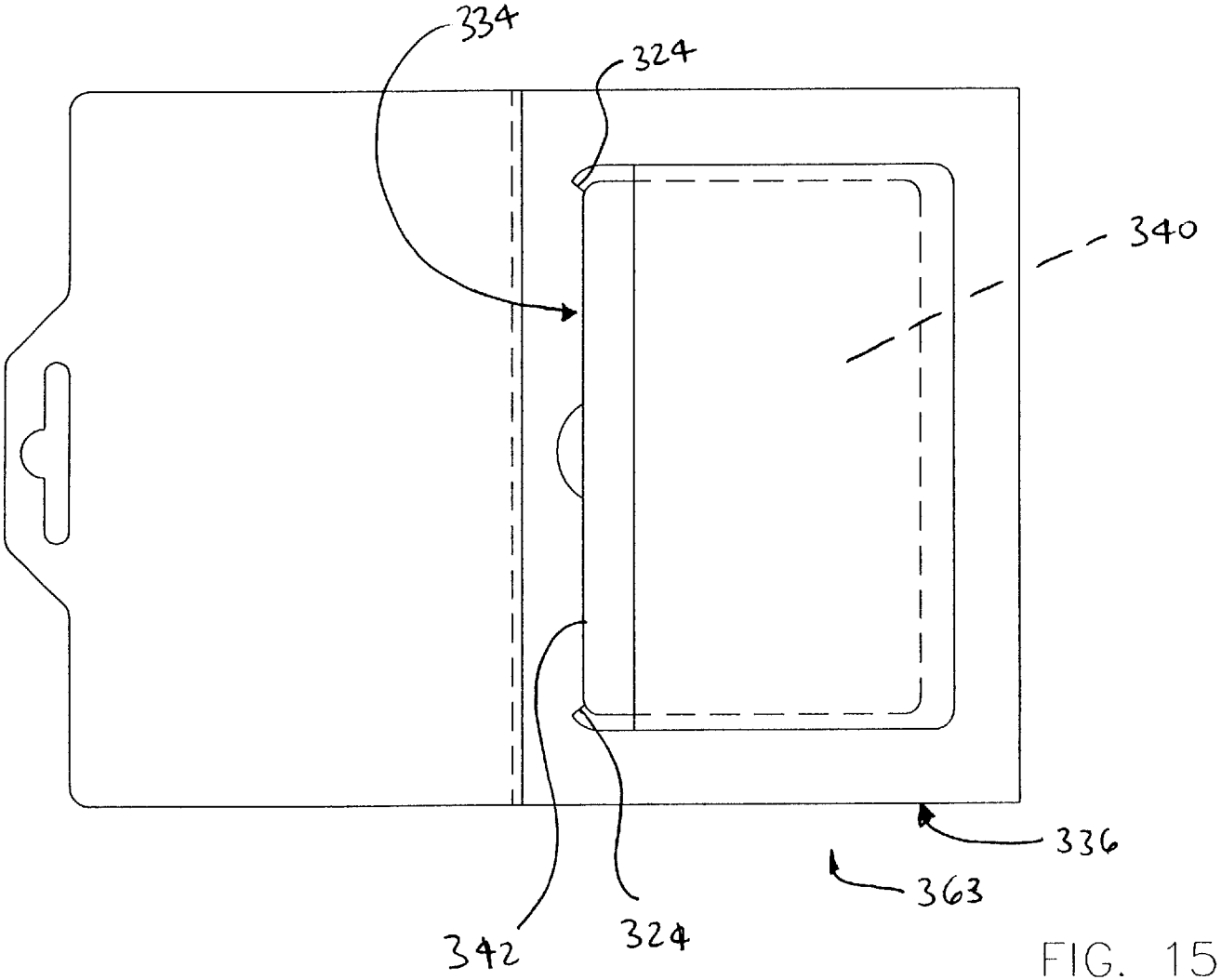
FIG. 15 is a plan view of an assembly in accordance with an additional exemplary embodiment of the present invention.

FIG. 15 is a plan view of an assembly 363 in accordance with an additional exemplary embodiment of the present invention. In the embodiment of FIG. 15 card 342 is seen overlaying locking tabs 324 of package 336. When card 342 is overlaying locking tabs 324, card 342 is preferably free to exit pocket 340 via passageway 334 of package 336. A method in accordance with present invention may include the steps of grasping assembly 362 of FIG. 13, urging package 336 to assume a generally bent shape, and allowing package 336 to assume a generally planar shape in which card 342 overlays locking tabs 342.

A method of providing a card in accordance with the present invention may include the steps of:

1) Providing a blank having a first panel and a second panel. Wherein the second panel defines an aperture and at least one locking tab extending into the aperture.
2) Positioning the card so that it overlays the first a panel of the blank.
3) Positioning the second panel so that the at least one locking tab overlays the card.
4) Urging the second panel to assume a generally bent shape.
5) Allowing the second panel to assume a generally planar shape in which the card overlays the at least one locking tab.

Several forms of invention have been shown and described, and other forms will now be apparent to those skilled in art. It will be understood that embodiments shown in drawings and described above are merely for illustrative purposes, and are not intended to limit the scope of invention defined claims which follow.

What is claimed is:

1. A package for storing and displaying a card, comprising:

a first panel having a first face;

a sheet having a plurality of fixed edges and a free edge, the sheet being fixed to the first face of the first panel proximate the plurality of fixed edges so that the sheet and the first panel define a pocket;

a second panel at least partially overlaying the first face of the first panel;

the second panel defining an aperture having a periphery;

the free edge of the sheet and the periphery of the aperture defining a passageway communicating with the pocket; and the periphery of the aperture defining at least one locking tab for selectively obstructing the passageway.

2. The package of claim 1, wherein the first panel is biased to assume a generally planar shape.

3. The package of claim 1, wherein the at least one locking tab extends into the passageway when the package is free to assume a generally planar shape; and the locking tab assuming an unlocked position when the package is urged to assume a generally arcuate shape, wherein the passageway is substantially unobstructed by the locking tab when the locking tab assumes the unlocked position.

4. The package of claim 1 further including a proximal portion, a distal portion, and middle portion disposed therebetween; and wherein the package is configured to preferentially bend proximate the middle portion.

5. The package of claim 1 further including a proximal portion, a distal portion, and middle portion disposed therebetween; and wherein the at least one locking tab is free to remain coplanar with the distal portion of the second panel when the middle portion of the second card is bent.

6. The package of claim 1, wherein the sheet comprises a substantially transparent material.

7. The package of claim 1, wherein the sheet comprises a substantially translucent material.

8. The package of claim 1, wherein the sheet is fixed to the first face of the first panel proximate the plurality of fixed edges by an adhesive.

9. The package of claim 1, wherein the sheet is fixed to the second panel proximate the plurality of fixed edges by an adhesive.

10. The package of claim 1, wherein the second panel at least partially overlays the sheet.

11. The package of claim 1, wherein the second panel is fixed to the first panel by an adhesive.

12. The package of claim 1, wherein the aperture includes a notch dimensioned to receive a human finger.

13. The package of claim 1, wherein the first panel defines an opening dimensioned to receive a human finger.

14. The package of claim 1, wherein the first panel defines an opening communicating with the pocket.

15. An assembly, comprising:

a first panel having a first face;

a sheet having a plurality of fixed edges and a free edge, the sheet being fixed to the first face of the first panel proximate the plurality of fixed edges so that the sheet and the first panel define a pocket;

a card at least partially disposed within the pocket;

a second panel at least partially overlaying the first face of the first panel;

the second panel defining an aperture having a periphery;

the free edge of the sheet and the periphery of the aperture defining a passageway;

the second panel forming at least one locking tab;

the at least one locking tab overlaying the card when the package is free to assume a generally planar shape, and the at least one locking tab being free to separate from the card when the package is urged to assume a generally arcuate shape.

16. The assembly of claim 1, wherein the first panel is biased to assume a generally planar shape.

17. The assembly of claim 1 further including a proximal portion, a distal portion, and middle portion disposed therebetween; and wherein the assembly is configured to preferentially bend proximate the middle portion.

18. The assembly of claim 1 further including a proximal portion, a distal portion, and middle portion disposed therebetween; and wherein the at least one locking tab is free to remain coplanar with the distal portion of the second panel when the middle portion of the second card is bent.

19. The assembly of claim 1, wherein the sheet comprises a substantially transparent material.

20. The assembly of claim 1, wherein the sheet comprises a substantially translucent material.

21. The assembly of claim 1, wherein the sheet is fixed to the first face of the first panel proximate the plurality of fixed edges by an adhesive.

22. The assembly of claim 1, wherein the sheet is fixed to the second panel proximate the plurality of fixed edges by an adhesive.

23. The assembly of claim 1, wherein the second panel at least partially overlays the sheet.

24. The assembly of claim 1, wherein the second panel is fixed to the first panel by an adhesive.

25. The assembly of claim 1, wherein the aperture includes a notch dimensioned to receive a human finger.

26. The assembly of claim 1, wherein the first panel defines an opening dimensioned to receive a human finger.

27. The assembly of claim 1, wherein the first panel defines an opening communicating with the pocket.

* * * * *